United States Patent [19]

Uchida

[11] 4,239,203

[45] Dec. 16, 1980

[54] PAPER DELIVERY ROLLER SYSTEM

[75] Inventor: Isamu Uchida, Tokyo, Japan

[73] Assignee: Laurel Bank Machine Co., Ltd., Tokyo, Japan

[21] Appl. No.: 859,081

[22] Filed: Dec. 9, 1977

[30] Foreign Application Priority Data

Dec. 10, 1976 [JP] Japan ..... 51/165733[U]

[51] Int. Cl.[3] ..... B65H 3/52

[52] U.S. Cl. ..... 271/122

[58] Field of Search ..... 271/122, 125, 262

[56] References Cited

U.S. PATENT DOCUMENTS 2,655,374 10/1953 Townsley ..... 271/125

3,771,783 11/1973 McIverny ..... 271/125

OTHER PUBLICATIONS

IBM Technical Disclosure Bulletin, vol. 19, No. 6, pp. 1978, 1979, Nov. 1976, "Separator/Restraint Paper Feed", J. L. Fallon et al.

*Primary Examiner*—Richard A. Schacher

*Attorney, Agent, or Firm*—Stevens, Davis, Miller & Mosher

[57] ABSTRACT

In a paper delivery roller system, frictional surfaces of a pair of rollers are composed of the same material and the length of frictional surfaces of the feed roller is longer than the length of the frictional surface of the return roller.

1 Claim, 5 Drawing Figures

PAPER DELIVERY ROLLER SYSTEM

The present invention relates to a delivery roller systems for delivering sheets of paper one by one.

For example, in a paper money exchanger, a horizontal stack of notes are stored in the interior of the exchanger and notes of the stack are delivered one by one. Such a paper delivery system is shown in FIGS. 1 and 2.

In the drawing, reference numerals 1 and 2 represent a feed roller and a return roller, respectively. Rotation shafts 1*a* and 2*a* of these rollers 1 and 2 are arranged in parallel to each other in the delivery zone so that the peripheral surfaces of both the rollers 1 and 2 are brought close to each other (with a gap corresponding to the thickness of one sheet of paper). Reference numeral 3 represents a horizontal stack of sheets of paper stored which is pressed against the feed roller 1 in the delivery zone by application of a desired force to the paper sheets so that the outermost sheet of paper 3*a* bears against the peripheral surface of the roller 1 at a part near the lower end thereof. Both the rollers 1 and 2 are rotated in the same direction. Namely, the feed roller 1 is rotated in a direction rolling up and delivering the outermost sheet of paper and the return roller 2 is rotated in a direction returning the sheet of paper. Accordingly, the outermost sheet 3*a* which is in contact with the peripheral face of the feed roller 1 is passed between both the rollers 1 and 2, but since the second and subsequent sheets of paper do not come into contact with the feed roller 1, the lower end portions of these sheets are subjected to only the returning force of the return roller 2 and they are not rolled up in between the two rollers 1 and 2. As shown in FIG. 2, the rollers 1 and 2 have on their peripheries frictional surfaces 4 and 5 composed of materials which are different in the frictional coefficient. A frictional force in the delivery direction is imposed on the upper face of the sheet paper 3*a* gripped between the rollers 1 and 2 and a frictional force in the return direction is imposed on the lower face of the sheet of paper 3*a*. However, since the frictional force by the feed roller 1 is larger than the frictional force by the return roller 2, paper sheet 3*a* is fed out from between the two rollers 1 and 2. After the outermost sheet has thus been fed out, the subsequent sheet of paper comes in contact with the feed roller 1 and it is rolled up and fed out in the above-mentioned manner. Thus, sheets of paper 3 in the stack are fed out one by one.

In this conventional paper delivery system, frictional surfaces 4 and 5 formed on the peripheries of both the rollers 1 and 2 are composed of materials having the different frictional coefficients so that a difference is caused between the frictional forces applied to the sheet of paper by the two rollers 1 and 2. However, determination of the frictional forces and setting of an appropriate difference in the frictional force by selecting the frictional face-constituting materials appropriately involve various difficulties. Further, the two rollers should be prepared separately by using different materials. Accordingly, the manufacture of the rollers requires time and labor and the manufacturing cost becomes high.

It is therefore a primary object of the present invention to provide a paper delivery roller system in which the frictional surfaces of both the rollers are composed of the same material and the above-mentioned difference of the frictional force is brought about between the two rollers by appropriately setting the ratio of lengths of the frictional surfaces of both the rollers with respect to the axial directions thereof.

One embodiment of the present invention will now be described by reference to the accompanying drawing.

Figure 1:
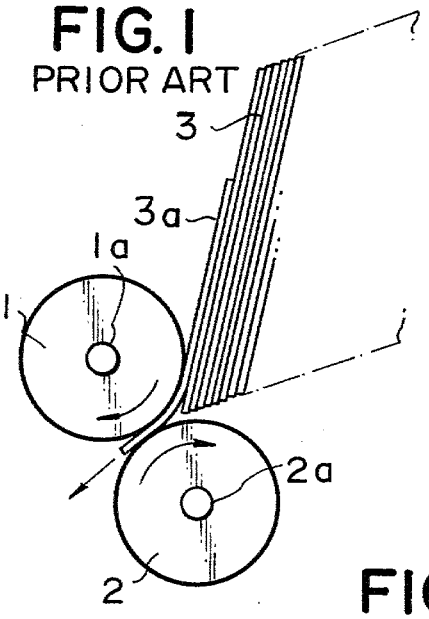
FIG. 1 PRIOR ART
FIG. 1 is a side elevational view showing the conventional paper delivery system.
Figure 2:
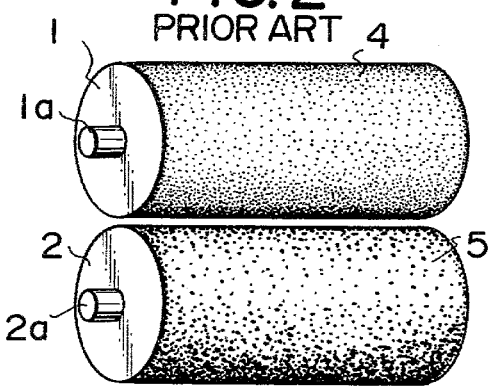
FIG. 2 PRIOR ART
FIG. 2 is a perspective view showing delivery rollers in the system shown in FIG. 1.
Figure 3:
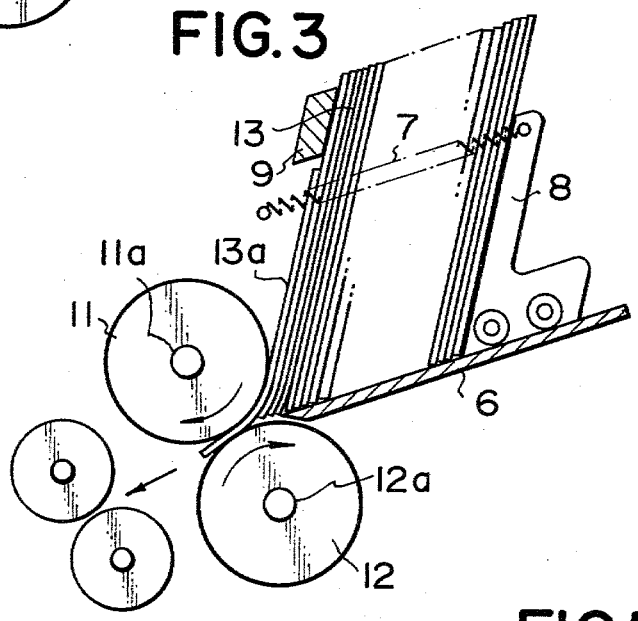
FIG. 3 is a side elevational view showing one embodiment of the device according to the present

As shown in FIG. 3, sheets of paper 13 are stored as a horizontal stack on a store stand 6 and pressed against a feed roller 11 in the delivery zone by means of a press member 8 being subjected to action of a spring 7. Accordingly, the outermost sheet of paper 13*a* bears against the peripheral surface of the feed roller 11 at a part near the lower end thereof. In the drawing, reference numeral 9 represents a support plate.

The feed roller 11 and return roller 12 are disposed in the delivery zone, and the rotation shafts 11*a* and 12*a* of both the rollers 11 and 12 are arranged in parallel to each other so that the peripheral surfaces of both the rollers 11 and 12 are brought close to each other with a gap corresponding to the thickness of one paper 13.

Figure 4:
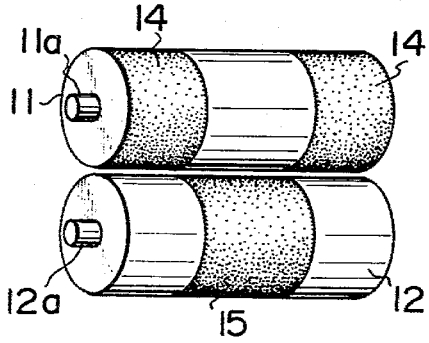
FIG. 4 is a perspective view showing delivery rollers in the system shown in FIG. 3.
Figure 5:
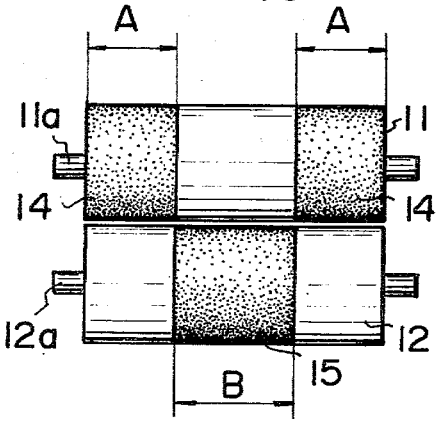
FIG. 5 is a front view showing the delivery rollers illustrated in FIG. 4.

As shown in FIGS. 4 and 5, frictional suraces 14 and 15 composed of the same material are formed on the peripheries of the feed roller 11 and return roller 12, respectively. The frictional surfaces 14 of the feed roller 11 have a width A, and are positioned on both the side portions except a central portion having a certain width with respect to the axial direction. The frictional surface 15 is formed on the return roller 12 in a central portion having a width B with respect to the axial direction. The frictional surfaces 15 of the return roller 12 is located at a position corresponding to the position of the central portion of the peripheral surface of the feed roller 11 where the frictional surface is not present. The total width 2A of the frictional surfaces 14 of the feed roller 11 is larger than the width B of the frictional surface 15 of the return roller 12. Accordingly, the total length of the frictional surfaces 14 with respect to the axial direction is larger than the length of the frictional surface 15 with respect to the axial direction. Formation of such frictional surfaces 14 and 15 on the peripheries of the rollers 11 and 12 may be accomplished, for example, by forming a step on the peripheral surface at a part on which a frictional surface is to be formed and bonding a band-like frictional material to this step or according to other optional means.

The shapes of the frictional surfaces 14 and 15 are not limited to those specifically illustrated in the foregoing embodiment, and any shapes can be adopted as long as the length of the frictional surface 14 of the feed roller 11 with respect to the axial direction is larger than the length of the frictional surface of the return roller 12 with respect to the axial direction. Moreover, the method of forming the frictional surfaces is not limited to the method illustrated in the foregoing embodiment, and various other methods may be adopted.

In the paper delivery roller system of the present invention having the above-mentioned structure, among a horizontal stack of sheets of paper stored in the store zone, the outermost sheet of paper alone is introduced between the two rollers 11 and 12 as in the above-mentioned conventional system, and one surface of this sheet is subjected to the frictional force in the delivery direction by the frictional surfaces 14 of the feed roller 11 and at the same time, the other surface of the sheet is subjected to the frictional force given in the return direction by the frictional surface 15 of the return roller 12. Since the sheet of paper is not a rigid body, loads imposed on the sheet of paper gripped between the rollers 11 and 12 are given to the respective parts falling in contact with the frictional surfaces 14 and 15. Accordingly, although the frictional surfaces 14 and 15 are composed of the same material and they have the same frictional coefficient, since the length of the frictional surfaces 14 of the feed roller 11 with respect to the axial direction is larger than the length of the frictional surface 15 of the return roller 12 with respect to the axial direction, the friction force given by the frictional face 14 of the feed roller 11 is larger than the frictional force given by the frictional surface 15 of the return roller 12 (the frictional force is equal to the product of the frictional coefficient and the load). Accordingly, the sheet of paper is delivered from between the rollers 11 and 12.

As will be apparent from the foregoing illustration, since the frictional surfaces of both the feed roller and return roller are composed of the same material and sheets of paper can be delivered by the rollers by appropriately setting the lengths of the frictional surfaces of both the rollers with respect to the axial directions thereof, difficulties encountered in the conventional system where a certain difference of the frictional force is brought about by selecting appropriately different materials for the frictional surfaces of both the rollers can be eliminated. Further, since the frictional surfaces of both the rollers can be formed by using the same material, the manufacturing cost can be reduced in the present invention. Still further, in the present invention, an optimum delivery condition can easily be realized by appropriately setting the length of the frictional surface of each roller with respect to the axial direction.

What is claimed is:

1. A paper delivery roller system comprising a feed roller 11 and return roller 12 of identical axial length disposed in a delivery zone so as to form a gap therebetween, said rollers 11 and 12 being rotated in the same direction so that frictional forces acting in reverse directions are given to the upper and lower faces of the outermost sheet in a stack of sheets of paper stored in a store zone whereby the sheets of paper stored in the store zone are delivered one by one into the gap between said rollers 11 and 12, said paper delivery roller system being characterized by said rollers 11 and 12 having frictional surfaces 14 and 15 of the same material thereon respectively and the axial length of the frictional surfaces 14 of the feed roller 11 being larger than the axial length of the frictional surfaces 15 of the return roller 12 and each of the frictional surfaces of one of the rollers being in opposed relation to each of the non-frictional surfaces of the other.

* * * * *